US009210961B2

(12) United States Patent
Torres

(10) Patent No.: US 9,210,961 B2
(45) Date of Patent: Dec. 15, 2015

(54) CEPHALIC PROTECTION CELL (CPC)

(76) Inventor: Mauricio Paranhos Torres, São Paulo (BR)

( * ) Notice: Subject to any disclaimer, the term of this patent is extended or adjusted under 35 U.S.C. 154(b) by 985 days.

(21) Appl. No.: 11/989,069

(22) PCT Filed: Aug. 18, 2005

(86) PCT No.: PCT/BR2005/000166

§ 371 (c)(1),
(2), (4) Date: Jan. 18, 2008

(87) PCT Pub. No.: WO2007/019653

PCT Pub. Date: Feb. 22, 2007

(65) Prior Publication Data

US 2009/0031480 A1 Feb. 5, 2009

(51) Int. Cl.

| | |
|---|---|
| ***A42B 3/06*** | (2006.01) |
| ***A42B 3/12*** | (2006.01) |
| ***A42B 3/32*** | (2006.01) |
| *A42B 3/20* | (2006.01) |

(52) U.S. Cl.

CPC . *A42B 3/063* (2013.01); *A42B 3/06* (2013.01); *A42B 3/12* (2013.01); *A42B 3/326* (2013.01); *A42B 3/20* (2013.01); *A42B 3/205* (2013.01)

(58) Field of Classification Search

USPC ..... 2/455, 410, 425, 6.8, 411, 412, 413, 2/414, 424, 15, 429, 9

IPC ..... A42B 3/06,3/063, 3/066, 3/18, 3/20, A42B 3/205

See application file for complete search history.

(56) References Cited

U.S. PATENT DOCUMENTS

| | | | | |
|---|---|---|---|---|
| 3,946,441 | A * | 3/1976 | Johnson | 2/412 |
| 4,023,213 | A * | 5/1977 | Rovani | 2/413 |
| 4,483,021 | A * | 11/1984 | McCall | 2/7 |
| 4,524,465 | A * | 6/1985 | Huber | 2/424 |
| 4,534,068 | A * | 8/1985 | Mitchell et al. | 2/414 |
| 4,627,115 | A * | 12/1986 | Broersma | 2/425 |
| 4,665,569 | A * | 5/1987 | Santini | 2/425 |
| 4,764,990 | A * | 8/1988 | Markert | 2/429 |
| 5,056,162 | A * | 10/1991 | Tirums | 2/412 |
| 5,315,718 | A * | 5/1994 | Barson et al. | 2/418 |
| 5,687,426 | A * | 11/1997 | Sperber | 2/411 |
| 5,713,082 | A * | 2/1998 | Bassette et al. | 2/412 |
| 5,745,923 | A * | 5/1998 | Katz | 2/411 |
| 6,226,803 | B1 * | 5/2001 | Tanaka | 2/424 |
| 6,282,724 | B1 * | 9/2001 | Abraham et al. | 2/412 |
| 6,282,726 | B1 * | 9/2001 | Noyerie et al. | 2/424 |
| 6,339,849 | B1 * | 1/2002 | Nelson et al. | 2/425 |
| 6,360,376 | B1 * | 3/2002 | Carrington | 2/412 |

(Continued)

FOREIGN PATENT DOCUMENTS

| | | |
|---|---|---|
| EP | 1 183 956 | 3/2002 |
| WO | WO 2005/000059 | 1/2005 |

*Primary Examiner* — Christopher Harmon

(74) *Attorney, Agent, or Firm* — Leydig, Voit & Mayer, Ltd.

(57) ABSTRACT

A new concept in cranial protection, is a device of individual protection with the purpose of protect the user's head against impact and decelerations. The Cephalic Protection Cell must be used with the objective of avoid direct injuries caused by impact and indirect injuries caused by deceleration, resting and, at the same time, improving the amount of time in which a contact strength is applied to the head, preventing, this way, localized injuries (by impact) or spreaded injuries (by deceleration) in the brain and in other internal structures of the cranium, and also regarding its hability to preserve the cervical spine, thanks to its less mass.

7 Claims, 2 Drawing Sheets

(56) References Cited

U.S. PATENT DOCUMENTS

| | | | | |
|---|---|---|---|---|
| 6,434,755 | B1 * | 8/2002 | Halstead et al. | 2/414 |
| 6,446,270 | B1 * | 9/2002 | Durr | 2/412 |
| 6,748,607 | B1 * | 6/2004 | Hong | 2/422 |
| 6,968,575 | B2 * | 11/2005 | Durocher | 2/425 |
| 7,062,795 | B2 * | 6/2006 | Skiba et al. | 2/410 |
| 7,089,602 | B2 * | 8/2006 | Talluri | 2/411 |
| 7,207,071 | B2 * | 4/2007 | Pierce | 2/410 |
| 7,240,376 | B2 * | 7/2007 | Ide et al. | 2/425 |
| 7,328,462 | B1 * | 2/2008 | Straus | 2/411 |
| 7,841,026 | B2 * | 11/2010 | Makris et al. | 2/424 |
| 8,615,817 | B2 * | 12/2013 | Phillips | 2/411 |
| 2003/0182716 | A1 * | 10/2003 | Wu | 2/424 |
| 2006/0059605 | A1 * | 3/2006 | Ferrara | 2/410 |
| 2008/0155735 | A1 * | 7/2008 | Ferrara | 2/412 |
| 2008/0256686 | A1 * | 10/2008 | Ferrara | 2/413 |

* cited by examiner

CEPHALIC PROTECTION CELL (CPC)

The present report is a detailed description, followed by elucidative figures, of a new concept of head protection, called Cephalic Protection Cell (CPC), which is a device of individual protection with the purpose of protect the user's head against impacts and decelerations, having an innovative architecture, which is not only cosmetic, or in design, but also modifies the concept of today's "helmets", that remain established and unchanged for at least 30 years.

The purpose of this invention is to substitute the helmets that exist today, since the expression "helmet" is used to identify several devices of individual protection to many different activities (automobilistic, cyclistic, military, construction, aeronautics, etc.), all of them following the same principle, which is contested and modified by the Cephalic Protection Cell proposed by this patent. The expression "helmet" is purposefully avoided here, in order to make very clear that this invention is not a model of utility, but a new invention that starts form a concept of function and configuration.

Personal observations made by the author/inventor during his professional practice (Neurosurgery), and later grounded by scientific works, show that the skull (cranium), either of the humans or of several animals, has some characteristics that make it, along with other anatomical details of the head, an exceptional protection cell for the brain that, in essence, is the structure that make us what we are, and that any safety device must preserve.

This can be easily noticed in nature, where one can observe the mountain goats (*capra hircus*) fighting for their territories with frontal head blows in a great speed, without suffering significant damages.

The automobilistic helmets we have today, that can be replaced by the CPC with great advantages, are big and heavy, facts that, unfortunately, do not stimulate their use. These helmets, due to their configuration, expose the cranio-cervical joint, narrow the visual field, and do not avoid the internal rotation of the head in their interior at the moment of the impact, causing injuries in the face and in the occipital area (we all remember the accident with Rubens Barrichello in that terrible F1 GP of Imola in 1994—the images showed, for a few instants, that more than half of his face was exposed, which resulted in facial injuries and nasal fracture).

The present design of helmets construction are at least 30 years old and, although they offer a good protection on impact, in this period there wasn't any significant innovations, either in their architecture or in the use of materials, which are the innovations pretended by the CPC.

There are three possibilities of injuries in the Central Nervous System (CNS), in the event of an accident:

1. the direct impact, that depends of the strength applied on a certain area.

2. the deceleration, linked with the amount of movement, that is, related with inertia.

3. and what occurs more frequently, the combination between impact and deceleration, being more serious when the impact turns from the gravity center of the head, causing an angular acceleration.

Therefore, according to what was exposed and what is demonstrated by the Mechanics of Newton, the intensity of the developed injury depends of the speed, the acceleration, the time (related to the initial and final movements) and the object's mass.

Consequently, is essential to reduce the helmet's mass in order to reduce the possibility of injuries, as was exposed above, and besides increasing the total mass of the head, the helmets will favor injuries in the cervical spine, which is the axle of retention of its movement.

The present helmets are just a "shell" with only one layer of approximately 4.5 mm of thickness, made with a polymerized material, internally coated with an absorber layer of impact made of polystyrene that can have 40 mm or more of thickness in some points, and with a fabric coating in an attempt to give comfort. This configuration, as we said before, is at least 30 years old and cannot undergo significant changes without compromising its performance by the standard regulations.

Studies made through computed tomographies of automotive helmets after accidents (Cooter, 1990) demonstrated the occurrence of a number of fractures, smashes and dislocation of their internal structures, some not even perceptive from outside.

The inevitable conclusion is that this device (the present helmet) must undergo a conceptual evolution that will turn the protection of the head and brain into something more effective and efficient. This way, in a certain impulse, the cranial protection device must reduce the average strength (increasing the time during which the strength of impact is applied) and consequently the acceleration, reducing the chances of damages to the brain. This is what we propose with the Cephalic Protection Cell (CPC), object of the present patent.

Next there are references to the Figures that illustrate this descriptive report, for a better understanding.

Figure 1:
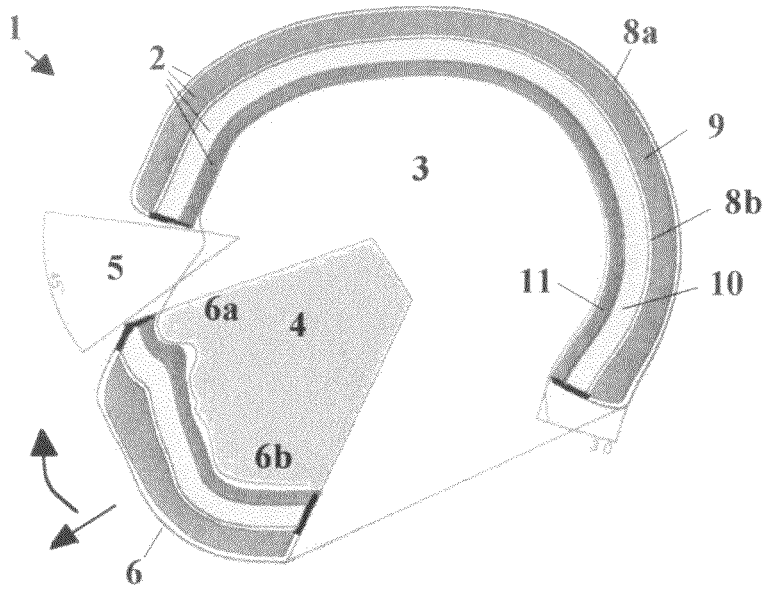
FIG. 1 shows the Cephalic Protection Cell (CPC), object of this patent, in a transversal cut, highlighting all its configuration details and structure composition.
Figure 2:
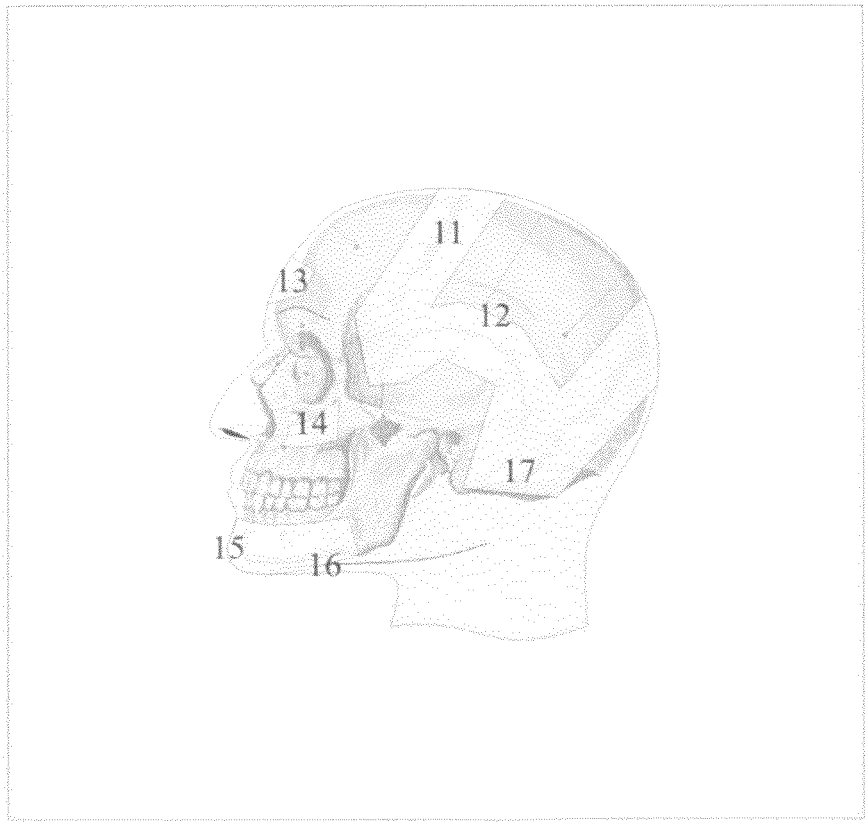
FIG. 2 shows the Cephalic Protection Cell (CPC), object of this patent, pointing out the shape and placement of the internal contact layer, which present its shape following the bone structure of the cranium, according to its sutures.
Figure 3:
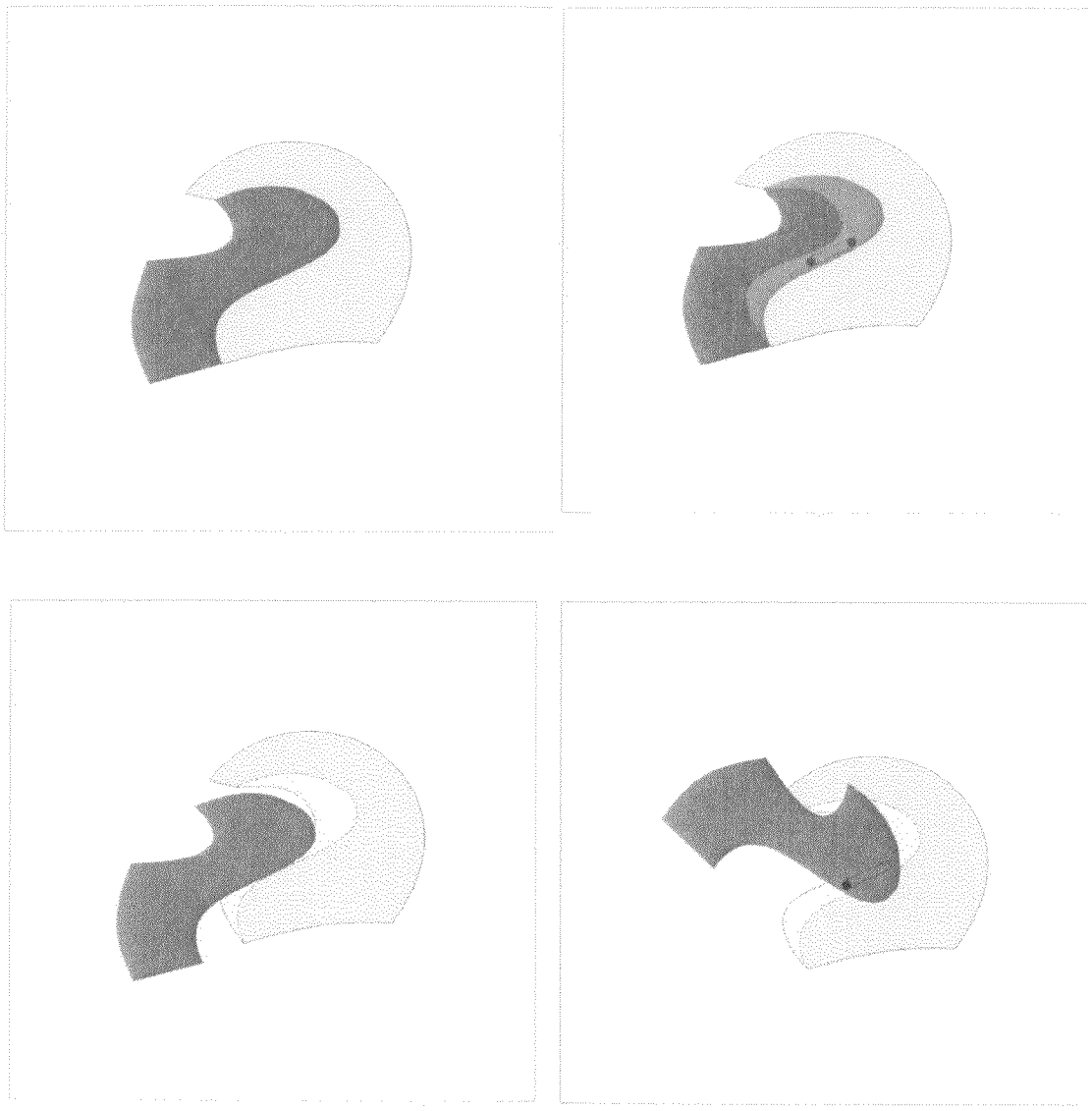
FIG. 3 shows a diagram of the Cephalic Protection Cell (CPC), object of this patent, in a possible way of realization, pointing out its opening and closing details when handled by the user.

The Cephalic Protection Cell (CPC), object of this patent, is a safety device for the head, which innovation is the inspiration of its construction, based in the human cranium, specially in its external double bone layer, and in other anatomical details of brain preservation.

The Cephalic Protection Cell (1) is described as:

1. A rigid structure (2) that involves the cranium (3) and the face (4) in all their extension, from the submental vertex until the inferior part of the occipital protuberance (inion), extending to the cranio-cervical joint with an opening for the eyes (5), preserving and enlarging the user's visual field, thanks to its less thickness.

2. The chin bar (6) extends until the cover of the nasal area (6) and moves in flip-up (7) in the direction of the visor, allowing an easy placement and, particularly, an easy pull out in case of accident, with no risks of worse damages to the cervical spine. From the submental vertex, the chin bar extends to under the chin (6), restricting the head's rotation and the face's exposure in the event of an impact (fourth innovation). All this architecture is possible only because the Cephalic Protection Cell is considerably smaller and lighter than its equivalents that exist today.

3. The shell has a double layer (7) simulating the flat bones of the skull, and this is an innovation when compared with what exist today. The external (8*a*) and internal (8*b*) layer of this shell are made of polymerized material and reinforced with the addition of impact modifiers based on elastomers, that can be polyester resin of equivalent, classified as termofixed or termorigid, which can be additivated with mineral micronizeds charges, flame retarding or not, depending on the purpose of its use, that, along with a blanket or fabric, preferably in aramid or equivalent, will make a composite with the approximate thickness of 2 mm per layer. In its interior (9), between the external and internal layers, there is a material that absorbs and dissipates the impact, which is a sponge of trabecular material, properly treated with adherence and tenacity promoters and with hylan gel. This trabecular structure, which is also an innovation, makes the energy of the impact to dissipate through the anisotropic structure, when a resulting strength falls on the external face of the Cephalic Protection Cell, in a way that increases the area of strength exertion and the length of time of the impact, by decomposing the strength into small vectors to directions that will not produce deceleration or damage impact to the brain. With this configuration the whole external shell of the Cephalic Protection Cell should have approximately 1 cm thickness.

4. Immediately under the external shell, and adhered to it, again with the purpose of protecting against direct impacts, but also to offer a greater comfort to the user, there is a layer (10) of approximately 10 mm thick, made of flexible polyurethane foam (PU), obtained through the reaction of water/isocyanate with polyol, filled with plastic bubbles or similar material, which will allow a non-permanent distortion, but of absorption of mechanic and pneumatic impact. To a better distribution of weight that can eventually pass through the anisotropic structure of the trabecular material to the inferior layer of the polymerized material, there is a ramification of reticulated polyetilen with density of approximately 250 kg/m3, which passes through the flexible PU foam, mentioned above, with the same thickness of approximately 10 mm, with the purpose of distribute and redirect the applied strength to the areas of greater resistance of the skull. This layer, therefore, is also an innovation.

5. The described support for the structure with the skull is done through cells closed and filled (11) with viscoelastic polymer in gel form, or filled with air or gas, pressurized or not, or, still, filled with equivalent material with the same properties, supported in the areas of cranial sutures, with extensions to the bone surfaces (12). These extensions have free room for expansion. In addition to these points (sutures) the support is also done in the face, in the frontal areas (13), maxillas (14), mento (15), mandibular arch (16) e mastoid (17). The purpose of this configuration is to dissipate and absorb force vectors that eventually will pass through the anterior layers, and is also an innovation.

With the already mentioned architecture, the protection device, or Cephalic Protection Cell, will be considerably smaller and lighter when compared to the equivalents available in the market, the present helmets. Its final weight, as described, is estimated in numbers between 0.8 to 1 kg, which means a very significant reduction when compared to the present helmets, whose weight is about 1.4 kg, with, we believe, better performance.

So, as it was exhaustively related above, the Cephalic Protection Cell must be used to avoid direct injuries that occur by impact, and indirect injuries that occur by deceleration, resisting and, at the same time, increasing the amount of time during which a contact strength is applied to the head, this way preventing localized injuries (by impact) or spreaded injuries (by deceleration) in the brain and other internal structures of the cranium, without losing its hability to preserve the cervical spine, thanks to its less mass.

As we said, the innovation brought by the Cephalic Protection Cell, when compared to the present helmets, makes the protection to the cranium and cervical spine much more effective, improving the protection against injuries caused by impact and deceleration and, being smaller and lighter, stimulates its use in the present situation, when there is a growing interest for motorcycles, helping to diminish the enormous social and monetary costs caused by motorcycles accidents, and also enlarging the protection to several other kinds of activities that may cause damages to the integrity of the cranium and, consequently, of the Central Nervous System.

According to the functioning and configuration characteristics described above, it is very clear that the Cranial Protection Cell is an object totally new to the State of the Art, and that it has all the necessary condition to obtain the Privilege of Invention Patent.

The invention claimed is:

1. A cephalic protection cell to protect the head of a wearer against impact and decelerations, the head including a face, eyes, nasal area, chin, and a skull having cranial sutures, frontal areas, maxillae, mentum, mandibular arches, and mastoids, the cephalic protection cell comprising:

a rigid structure configured to cover at least a portion of the head and face of the wearer, the rigid structure including an opening for the eyes of the wearer and a chin protector configured to extend from the nasal area to under the chin of the wearer, wherein the rigid structure comprises:

a shell comprising an internal layer, an external layer, and an interior between the internal and external layers, the internal and external layers comprising a polymerized material and the interior comprising a trabecular material;

a flexible polyurethane foam layer adhered to the internal layer of the shell, the flexible polyurethane foam layer having a thickness approximately equal to that of the shell; and a layer of closed cells adhered to the flexible polyurethane foam layer, wherein the layer of closed cells of the rigid structure is configured to contact the cranial sutures, frontal areas, maxillae, mentum, mandibular arches, and mastoids of the head of the wearer, and wherein the internal and external layers of the shell are lined with an aramid fabric.

2. The cephalic protection cell of claim 1, wherein layer of closed cells of the rigid structure further comprises extensions adapted to be disposed adjacent to the cranial sutures of the head of the wearer, the extensions being configured to support at least part of the rigid structure on the cranial sutures.

3. The cephalic protection cell of claim 1, wherein layer of closed cells of the chin protector of the rigid structure is configured to abut the nasal area of the wearer.

4. The cephalic protection cell of claim 1, wherein the layer of closed cells further comprises reticulated polyethylene.

5. The cephalic protection cell of claim 1, wherein the closed cells of the layer of closed cells are filled with a fluid.

6. The cephalic protection cell of claim 5, wherein the fluid is pressurized.

7. The cephalic protection cell of claim 1, wherein the chin protector is configured to shift forward and flip upward.

* * * * *